US007550414B2

(12) United States Patent
Tamoto

(10) Patent No.: US 7,550,414 B2
(45) Date of Patent: Jun. 23, 2009

(54) LUBE BASED OIL AND LUBRICATING OIL COMPOSITION

(75) Inventor: Yoshitaka Tamoto, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 142 days.

(21) Appl. No.: 11/568,575

(22) PCT Filed: Jun. 1, 2005

(86) PCT No.: PCT/JP2005/010052

§ 371 (c)(1),
(2), (4) Date: Nov. 2, 2006

(87) PCT Pub. No.: WO2005/118755

PCT Pub. Date: Dec. 15, 2005

(65) Prior Publication Data

US 2007/0225180 A1 Sep. 27, 2007

(30) Foreign Application Priority Data

Jun. 3, 2004 (JP) ..... 2004-165691

(51) Int. Cl.
*C10M 159/18* (2006.01)
*C10M 135/18* (2006.01)

(52) U.S. Cl. ..... 508/362; 508/363

(58) Field of Classification Search ..... 508/362, 508/580, 363
See application file for complete search history.

(56) References Cited

U.S. PATENT DOCUMENTS 5,458,807 A * 10/1995 Tamoto ..... 508/192
2006/0166844 A1* 7/2006 Egawa et al. ..... 508/579

FOREIGN PATENT DOCUMENTS

| | | | |
|---|---|---|---|
| JP | 09 059662 | | 3/1997 |
| JP | 10 324883 | | 12/1998 |
| JP | 2004 051720 | | 2/2004 |
| WO | 2004 058928 | | 7/2004 |
| WO | WO 2004/058928 | * | 7/2004 |
| WO | 2004 090082 | | 10/2004 |

* cited by examiner

*Primary Examiner*—Walter D Griffin
*Assistant Examiner*—Frank C Campanell
(74) *Attorney, Agent, or Firm*—Oblon, Spivak, McClelland, Maier & Neustadt, P.C.

(57) ABSTRACT

Provided is a lube base oil capable of giving a lubricating oil composition which has a low viscosity, but is small in evaporation amount has a low coefficient of friction and excellent adaptability for organic materials, and is suitable for use in a high-temperature atmosphere and a lubricating oil composition containing the lube base oil and having such properties. The lube base oil comprises as a main component an ether compound represented by the general formula $R^1$—O—$R^2$ (wherein $R^1$ and $R^2$ each independently represents an alkyl group having 2 to 26 carbon atoms) has a kinematic viscosity at 100° C. of 3.5 $mm^2/s$ or lower, has a mass loss through evaporation as measured through Noack test (at 250° C.; 1 hour) of 30% by mass or lower and/or has a flash point of 200° C. or higher, and has an aniline point of 60° C. or higher. The lubricating oil composition comprises (A) the lube base oil and (B) an organomolybdenum compound incorporated therein in an amount of 100 to 2,000 ppm by mass in terms of molybdenum amount based on a total amount of the composition.

5 Claims, No Drawings

LUBE BASED OIL AND LUBRICATING OIL COMPOSITION

TECHNICAL FIELD

The present invention relates to a lube base oil and to a lubricating oil composition and, more particularly, to a lube base oil capable of giving a lubricating oil composition which has a low viscosity but is small in evaporation amount, which has a low coefficient of friction and excellent adaptability for organic materials and which is suitable for use in a high temperature atmosphere, and to a lubricating oil composition containing the lube base oil and having the above properties.

BACKGROUND ART

In recent years, a reduction of friction is an important function of lubricating oil compositions for the achievement of energy savings and fuel savings. The use of a lubricating oil composition having a high viscosity, however, is disadvantageous because a load is applied to a pump for feeding the lubricating oil composition and because a loss in stirring the lubricating oil composition is caused. To cope with these problems, an attempt is generally made to reduce the viscosity of a lubricating oil composition. In the case of a lubricating oil composition whose viscosity is reduced by a conventional method, however, there is a problem because a loss of the lubricating oil composition is caused due to evaporation especially when it is used in a high temperature environment. Further, there is a problem that the coefficient of friction of a lubricating film rather increases with a reduction of the viscosity of the lubricating oil composition.

On the other hand, internal combustion engines are more and more required to be of a fuel saving type. To meet with such a requirement, the viscosity of an engine oil is further reduced. However, a low viscosity oil, which is susceptible to be vaporized when subjected to high temperatures in the engine, is discharged together with a waste gas during use. Therefore, the viscosity of the low viscosity oil gradually increases to cause an increase of the fuel consumption. With a view toward solving such problems of the conventional oils, Noack test has been newly introduced as an index of vaporizability. Thus, there is an increasing utilization of a low viscosity base oil which meets with the requirement for low vaporizability.

When a mineral base oil is used for the purpose of obtaining a low viscosity lubricating oil composition, there is caused a problem that the amount of vaporization of the lubricating oil composition considerably increases. Thus, an attempt has been made to use various synthetic base oils. As a lube base oil having a low viscosity and a low vaporizability, an ester type base oil is known (see, for example, Patent Document 1 and Non-Patent Document 1). The ester type base oil, however, has a high polarity and causes an adverse effect (swelling) on organic materials. For example, when such an oil is used as an engine oil, there is caused a problem of swelling a rubber used as a seal material, etc. When such an oil is used as a fluid dynamic bearing oil, etc., there is caused a problem that a plastic material is adversely affected. There is also caused a problem that solubility of an additive in such an oil is poor.

A silicone oil is a lube base oil having a low viscosity and a low vaporizability, but has a problem because it has a poor lubricating property and is expensive. Poly-α-olefin (for example, an oligomer of 1-decene) is also known as a base oil having a low viscosity and a low vaporizability. However, poly-α-olefin of a viscosity grade of 4 $mm^2/s$ (100° C.) is not fully satisfactory with respect to a low viscosity and poly-α-olefin of a viscosity grade of 2 $mm^2/s$ (100° C.) is not fully satisfactory with respect to a low vaporizability.

Additionally, disclosed is a lube base oil containing a compound having an ether bonding and limiting to specific ranges of viscosity coefficient and pour point (see, for example, Patent Document 2). To meet with the requirement of further fuel saving, there is still a demand for a lube base oil having a lower viscosity and a lower vaporizability.

Patent Document 1: Japanese Unexamined Patent Publication Hei 08-245504

Non-Patent Document 1: "TRIBOLOGIST", 38(1), p 28-31 (1993)

Patent Document 2: Japanese Unexamined Patent Publication Hei 10-324883

DISCLOSURE OF THE INVENTION

Problems to be Solved by the Invention

The present invention has been made in the above-described circumstances and is aimed at the provision of a lube base oil capable of affording a lubricating oil composition which is low in viscosity and yet low in vaporizability, which has a low friction coefficient, which is excellent in adaptability for organic materials and which is suited for use in a high temperature environment, and at the provision of a lubricating oil composition which contains the above lube base oil and which has the above characteristics.

Means for Solving the Problems

The present inventors have made an earnest study to accomplish the above-described objects and, as a result, have found that the objects can be fulfilled by using a base oil which contains as a main ingredient a specific ether compound and which has specific ranges of kinematic viscosity, mass loss due to evaporation and aniline point. The present invention has been completed on the basis of such a finding.

Thus, the present invention provides the following lubricating oil and lubricating oil composition.

1. A lube base oil comprising as a main ingredient an ether compound represented by the following general formula (I):

$$R^1—O—R^2 \quad (1)$$

wherein $R^1$ and $R^2$ each independently represents an alkyl group having 2 to 26 carbon atoms, said lube base oil having a kinematic viscosity at 100° C. of 3.5 $mm^2/s$ or lower, a mass loss due to evaporation as measured according to Noack test (250° C., 1 hour) of 30% by mass or lower and/or a flash point of 200° C. or higher, and an aniline point of 60° C. or higher.

2. A lubricating oil composition comprising (A) a lube base oil as defined in 1 above, and (B) an organomolybdenum compound formulated therein in an amount of 100 to 2,000 ppm by mass in terms of molybdenum based on a total mass of the composition.
3. A lubricating oil composition as defined in 2 above, wherein the organomolybdenum compound is molybdenum dithiocarbamate.
4. A lubricating oil composition for an internal combustion engine, comprising a lubricating oil composition as defined in 2 or 3 above.

EFFECT OF THE INVENTION

The lubricating oil composition using the lube base oil of the present invention has a low viscosity and, therefore, is excellent in energy saving and fuel saving. Further, it has a low vaporizability and, therefore, scarcely emanates. Accordingly, it has only a small load against environment and can be used for a long period of time. Additionally, it has a small friction coefficient and good adaptability for organic materials and can be suitably used in a high temperature atmosphere.

BEST MODE FOR CARRYING OUT THE INVENTION

The lube base oil of the presents invention contains, as its main ingredient, an ether compound represented by the following genera formula (1):

$$R^1—O—R^2 \quad (1)$$

wherein $R^1$ and $R^2$ each independently represents an alkyl group having 2 to 26 carbon atoms. Each of the alkyl groups may be linear, branched or cyclic and may be, for example, an ethyl group, a propyl group, a butyl group, a hexyl group, a 2-ethylhexyl group, a 3,5,5-trimethylhexyl group, a heptyl group, an octyl group, a 3,7-dimethyloctyl group, a nonyl group, a 2-pentylnonyl group, a decyl group, a 2-octylundecyl group, a dodecyl group, a cyclopentyl group or a cyclohexyl group. In the present invention, an alkyl group having 8 to 20 carbon atoms is preferable. Concretely, the alkyl group is preferably a 2-ethylhexyl group, a 3,5,5-trimethylhexyl group, an octyl group, a 3,7-dimethyloctyl group, a nonyl group, a 2-pentylnonyl group, a decyl group or a 2-octylundecyl group.

The lube base oil of the present invention contains the above ether compound as its main ingredient. The term "main ingredient" as used herein is intended to mean that the ether compound is contained in the lube base oil in an amount of 70% by mass or higher, preferably 80% by mass or higher, more preferably 90% by mass or higher, particularly preferably 100% by mass. One or at least two kinds of the ether compounds may be contained in the lube base oil. The lube base oil may contain another base oil such as a mineral oil, a poly-α-olefin, an ethylene-propylene copolymer, an ester (monoester, diester, polyol ester, etc.), a polyether (polyalkylene glycol, etc.) or an alkylbenzene.

The lube base oil of the present invention must have a kinematic viscosity at 100° C. of 3.5 $mm^2/s$ or lower, preferably 3.3 $mm^2/s$ or lower. When the kinematic viscosity at 100° C. is 3.5 $mm^2/s$ or lower, it is possible to realize low viscosity, low vaporizability and energy and fuel savings. The base oil must also have a mass loss due to evaporation as measured according to Noack test (250° C., 1 hour) of 30% by mass or lower, preferably 25% by mass or lower. When the mass loss due to evaporation as measured according to Noack test (250° C., 1 hour) is 30% by mass or lower, the amount of evaporation of the base oil during use is small. Therefore, the service life of the base oil is prolonged and a trouble of a lack of oil amount is not caused even when the base oil is used in a high temperature atmosphere. The flash point must be 200° C. or higher, preferably 210° C. or higher, more preferably 220° C. or higher. When the flash point is 200° C. or higher, the amount of evaporation of the base oil during use is small and, therefore, the service life of the base oil is prolonged.

Incidentally, there is a case where the Noack test fails to reflect the actual vaporizability due to an influence of oxidative decomposition, etc. While occurrence of such an occasion can be prevented by addition of an antioxidant, the vaporizability of the base oil is specified in the present invention by combination of the Noack test with the flash point.

Further, the base oil must have an aniline point of 60° C. or higher, preferably 80° C. or higher, more preferably 90 to 110° C. When the aniline point is 60° C. or higher, swelling of organic materials, such as plastics and rubbers used in an apparatus, can be prevented. Thus, the adaptability to organic materials can be improved. When the aniline point is 110° C. or lower, shrinkage of organic materials can be prevented.

Although the lube base oil of the present invention can be used by itself as a lubricating oil, it is preferred that the lube base oil be used as a lubricating oil composition formulated with various additives depending upon the objects of utilization thereof such as usage as an engine oil. Such a lubricating oil composition of the present invention includes (A) the above lube base oil, and (B) an organomolybdenum compound. As the organomolybdenum compound of the component (B), there may be mentioned molybdenum dithiophosphate (MoDTP), molybdenum dithiocarbamate (MoDTC) and molybdenum amine salts. Above all, molybdenum dithiocarbamate (MoDTC) is preferred. The component (B) may be used singly or in combination of two or more thereof.

The component (B) must be used in an amount of 100 to 2,000 ppm by mass in terms of molybdenum based on a total mass of the composition. When the amount of the component (B) is 100 ppm by mass or more in terms of molybdenum, a sufficient friction reducing effect is obtainable. When the amount is 2,000 ppm by mass or less, an improvement in friction reducing effect is obtainable in match with the amount used. Therefore, a balance between the addition effect and economy is good. Additionally, a coking deposit does not occur. The amount is preferably 200 to 2,000 ppm by mass, more preferably 300 to 1,000 ppm by mass, in terms of molybdenum.

Various kinds of additives may be incorporated into the lubricating oil composition of the present invention, as necessary. For example, there may be mentioned an antioxidant such as an amine-based compound, e.g. alkylated diphenylamine, phenyl-α-naphthylamine or alkylphenyl-α-naphthylamine, a hindered phenol compound, e.g. 2,6-di-t-butylphenol or 4,4'-methylene-bis(2,6-di-t-butylphenol), or a sulfur containing compound, e.g. dilauryl-3,3'-thiodipropinoate; a viscosity index improver such as a polymethyl methacrylate, a polyisobutylene, an ethylene-propylene copolymer, a styrene-isopropylene copolymer or a hydrogenated styrene-butadiene polymer; a detergent dispersant such as a metal-based detergent, e.g. an alkaline earth metal sulfonate, an alkaline earth metal phenate, an alkaline earth metal salicylate or an alkaline earth metal phosphonate, or a non-ash dispersant, e.g. alkenyl succinimide, benzylamine, alkylpolyamine or alkenyl succinate ester, a friction reducing agent such as an aliphatic alcohol, a fatty acid, a fatty acid ester, an aliphatic amine, a fatty amine salt or a fatty acid amide; a metal deactivator such as benzotriazole, thiadiazole or alkenyl succinate ester, a pour point depressant such as polyalkylmethacrylate or polyalkylstyrene; an antiwear agent other than component (B), such as an organozinc compound, e.g. ZnDTP, an organoboron compound, e.g. alkylmercaptyl borate, or a solid lubricant antiwear agent, e.g. graphite, molybdenum disulfide, antimony sulfide, a boron compound or polytetrafluoroethylene; an antifoaming agent such as dimethylpolysiloxane or polyacrylate; and an extreme pressure agent such as sulfurized fat, sulfurized olefin, polysulfide, dithiocarbamate or diphenyl sulfide.

The lube base oil of the present invention may be utilized, for example, as, first of all, an internal combustion engine oil and, rest, a hydraulic fluid, an automatic transmission fluid, a manual transmission fluid, a damper fluid, a gear fluid, a fluid dynamic bearing oil, an anti-friction bearing fluid, an oil impregnated bearing fluid, a sliding surface oil or a refrigerator oil. The lube base oil of the present invention can withstand the use in high temperature atmosphere and, therefore, is particularly suited as an engine oil.

EXAMPLES

The present invention will be next described in more detail by way of Examples but is in no way limited thereto. The kinematic viscosity, mass loss due to evaporation, flash point and aniline point of lube base oils and friction coefficient of lubricating oil compositions are measured according to the following methods.

(1) Kinematic viscosity

Kinematic viscosity was measured in accordance with JIS K2283 (100° C.).

(2) Mass loss due to evaporation

Mass loss was measured in accordance with ASTM D5800 (Noack test: 250° C., 1 hour).

(3) Flash point

Flash point was measured in accordance with JIS K2265.

(4) Aniline point

Aniline point was measured in accordance with JIS K2256.

(5) Friction coefficient

Using a block-on-ring test machine (manufactured by Falex Corp.) according to ASTM D2714, a test block H60 according to ASTM D3704 and a test ring S-10 according to ASTM D2714, a test was conducted at a speed of 1.0 m/s, a load of 20 Lbs (89 N) and at a temperature of 80° C. (oil bath temperature) for 5 minutes. A friction coefficient at the end of the test was determined.

Example 1

In a glass flask having an inside volume of 2 L, 300 g of 2-octyl-1-dodecanol, 300 g of 1-bromooctane, 30 g of tetrabutylammonium bromide, and 500 g of an aqueous sodium hydroxide solution (a solution obtained by dissolving 150 g of sodium hydroxide in 350 g of water) were charged and the mixture was reacted at 50° C. for 20 hours with stirring.

After the completion of the reaction, the reaction mixture was transferred to a separatory funnel. The aqueous phase was separated and the remaining organic phase washed five times with 500 ml of water. From the organic phase, a compound yielded was separated by vacuum distillation.

The compound obtained was analyzed by a gas chromatography analyzing device (analyzer: Hitachi Model 263-70, column: OV-1 packed column manufactured by GL Science Inc. (2 m)) to confirm that the purity was over 99% (calculated from peak area) it was also confirmed by the analysis using a nuclear magnetic resonance apparatus ($^{1}$H-NMR, $^{13}$-NMRF: GSX400 manufactured by JEOL Ltd.) that the compound is an ether compound (ether compound A) of the above general formula (1) in which $R^1$ is a 2-octyl-dodecyl group and $R^2$ is a n-octyl group.

The base oil including the ether compound A was evaluated for above characteristics of (1) to (4). A lubricating oil composition obtained by incorporating molybdenum dithiocarbamate in the base oil including the ether compound A was measured for the friction coefficient. The results are shown in Table 1.

Example 2

In a glass flask having an inside volume of 2 L, 300 g of 2-octyl-1-dodecanol, 340 g of 1-bromodecane, 30 g of tetrabutylammonium bromide and 500 g of an aqueous sodium hydroxide solution (a solution obtained by dissolving 150 g of sodium hydroxide in 350 g of water) were charged and the mixture was reacted at 50° C. for 20 hours with stirring.

After the completion of the reaction, the reaction mixture was transferred to a separatory funnel. The aqueous phase was separated and the remaining organic phase washed five times with 500 ml of water. From the organic phase, a compound obtained was separated by vacuum distillation.

The compound obtained was analyzed by the same gas chromatography analyzing device as used in Example 1 to confirm that the purity was over 99% (calculated from peak area). It was also confirmed by the analysis using the same nuclear magnetic resonance apparatus as used in Example 1 that the compound is an ether compound (ether compound B) of the above general formula (1) in which $R^1$ is a 2-octyldodecyl group and $R^2$ is a n-decyl group.

The base oil including the ether compound B and a lubricating oil composition obtained by incorporating molybdenum dithiocarbamate in the base oil including the ether compound B were evaluated in the same manner as that in Example 1. The results are shown in Table 1

Examples 3 and 4 and Comparative Examples 1 to 4

Components shown in Table 1 were incorporated in the formulating amounts shown in Table 1 and the resulting compositions were evaluated in the same manner as that in Example 1. The results are shown in Table 1.

TABLE 1

TABLE 1-1

| | Composition (% by mass) | | Exampe 1 | Example 2 | Comparative Example 1 | Comparative Example 2 |
|---|---|---|---|---|---|---|
| Base Oil | Ether compound A[1)] | | 98.4 | — | — | — |
| | Ether compound B[2)] | | — | 98.4 | — | — |
| | Mineral oil[3)] | | — | — | 98.4 | — |
| | DOS[4)] | | — | — | — | 98.4 |
| (B) | MoDTC[5)] | | 1.6 | 1.6 | 1.6 | 1.6 |
| | SL additive[6)] | | — | — | — | — |
| Base Oil | Kinematic viscosity (100° C.) | $mm^2/s$ | 2.81 | 3.21 | 3.16 | 3.20 |
| | Noack (250° C., | % by mass | 24 | 22 | 37 | 18 |

TABLE 1-continued

TABLE 1-1

| | Composition (% by mass) | | Exampe 1 | Example 2 | Comparative Example 1 | Comparative Example 2 |
|---|---|---|---|---|---|---|
| | 1 hour) | | | | | |
| | Flash point | ° C. | 224 | 230 | 196 | 238 |
| | Aniline point | ° C. | 90 | 94 | 109 | <20 |
| Composition | Mo content | ppm by mass | 700 | 700 | 700 | 700 |
| | Ca content | ppm by mass | — | — | — | — |
| | Zn content | ppm by mass | — | — | — | — |
| | P content | ppm by mass | — | — | — | — |
| | Friction coefficient | — | 0.085 | 0.087 | 0.088 | 0.151 |

TABLE 2

TABLE 1-2

| | Composition (% by mass) | | Exampe 3 | Example 4 | Comparative Example 3 | Comparative Example 4 |
|---|---|---|---|---|---|---|
| Base Oil | Ether compound A[1)] | | 89.4 | — | — | — |
| | Ether compound B[2)] | | — | 89.4 | — | — |
| | Mineral oil[3)] | | — | — | 89.4 | — |
| | DOS[4)] | | — | — | — | 89.4 |
| (B) | MoDTC[5)] | | 1.6 | 1.6 | 16 | 1.6 |
| | SL additive[6)] | | 9 | 9 | 9 | 9 |
| Base Oil | Kinematic viscosity (100° C.) | $mm^2/s$ | 2.81 | 3.21 | 3.16 | 3.20 |
| | Noack (250° C., 1 hour) | % by mass | 24 | 22 | 37 | 18 |
| | Flash point | ° C. | 218 | 222 | 194 | 230 |
| | Aniline point | ° C. | 90 | 94 | 109 | <20 |
| Composition | Mo content | ppm by mass | 750 | 750 | 750 | 750 |
| | Ca content | ppm by mass | 1880 | 1880 | 1880 | 1880 |
| | Zn content | ppm by mass | 1070 | 1070 | 1070 | 1070 |
| | P content | ppm by mass | 960 | 960 | 960 | 960 |
| | Friction coefficient | — | 0.093 | 0.095 | 0.096 | 0.140 |

Remarks:
[1)]In the general formula $R^1$—O—$R^2$, $R^1$ is a 2-octyldodecyl group and $R^2$ is an octyl group
[2)]In the general formula $R^1$—O—$R^2$, $R^1$ is a 2-octyldodecyl group and $R^2$ is a decyl group
[3)]Refined mineral oil 70N
[4)]Di(2-ethylhexyl) sebacate (manufactured by Taoka Chemical Co., Ltd.)
[5)]Molybdenum dithiocarbamate (manufactured by Adeka Corporation, tradename: Sakuralube 165, Mo content: 4.5% by mass)
[6)]API SL Standard package additive

INDUSTRIAL APPLICABILITY

The lube oil and lubricating oil composition of the present invention are suited for applications as an internal combustion engine, etc., particularly as an engine oil, etc. used in a high temperature atmosphere.

The invention claimed is:

1. A lube base oil comprising as a main ingredient an ether compound represented by the following general formula (1):

$$R^1—O—R^2 \quad (1)$$

wherein $R^1$ and $R^2$ each independently represents an alkyl group having 2 to 26 carbon atoms, said lube base oil having a kinematic viscosity at 100° C. of 3.5 $mm^2/s$ or lower, a mass loss due to evaporation as measured according to Noack test (250° C., 1 hour) of 30% by mass or lower and/or a flash point of 200° C. or higher, and an aniline point of 60° C. or higher.

2. A lubricating oil composition comprising (A) a lube base oil as claimed in claim 1, and (B) an organomolybdenum compound formulated therein in an amount of 100 to 2,000 ppm by mass in terms of molybdenum based on a total mass of the composition.

3. A lubricating oil composition as claimed in claim 2, wherein the organomolybdenum compound is molybdenum dithiocarbamate.

4. A lubricating oil composition for an internal combustion engine, comprising a lubricating oil composition as claimed in claim 2.

5. A lubricating oil composition for an internal combustion engine, comprising a lubricating oil composition as claimed in claim 3.

* * * * *